US005219306A

United States Patent [19]

Takahashi

[11] Patent Number: 5,219,306

[45] Date of Patent: Jun. 15, 1993

[54] VIBRATION ABSORBING STRUCTURE OF OUTBOARD MOTOR

[75] Inventor: Hideharu Takahashi, Hamamatsu, Japan

[73] Assignee: Sanshin Kogyo Kabushiki Kaisha, Hamamatsu, Japan

[21] Appl. No.: 726,983

[22] Filed: Jul. 8, 1991

[30] Foreign Application Priority Data

Jul. 6, 1991 [JP] Japan ..... 2-179065

[51] Int. Cl.[5] ..... B63H 1/15

[52] U.S. Cl. ..... 440/52; 248/640

[58] Field of Search ..... 440/52, 53; 248/640

[56] References Cited

U.S. PATENT DOCUMENTS 3,062,173 11/1962 Kiekhaefer ..... 440/52

*Primary Examiner*—Jesûs D. Sotelo

*Attorney, Agent, or Firm*—Ernest A. Beutler

[57] ABSTRACT

A vibration absorbing structure for a marine outboard drive that is comprised of an elastic abutment between the drive shaft housing and clamping bracket and which has a greater resilience than the connection between the drive shaft housing and the steering shaft of the outboard drive so as to permit the absorption of rotational couples caused by vibrations without introducing undue resilience in the steering system of the outboard drive.

19 Claims, 3 Drawing Sheets

VIBRATION ABSORBING STRUCTURE OF OUTBOARD MOTOR

BACKGROUND OF THE INVENTION

This invention relates to a vibration absorbing structure for an outboard motor and more particularly to an improved damping arrangement for damping certain types of vibrations in marine outboard drives.

In conventional marine outboard drives such as outboard motors, the drive shaft housing is resiliently connected to a steering shaft by means of annular elastic bushings that have their axes disposed parallel to the propeller shaft axis. These elastic bushings are very effective in dampening the driving thrust transmitted from the outboard drive to the hull of the associated watercraft. However, there are other types of vibrational forces that are not effectively dampened by these members. For example, torsional vibrations can cause rotational couples about the drive shaft axis and irregular combustion can give rise to couples in the same general direction. If the elastic bushings that connect the drive shaft housing to the steering shaft are made resilient enough to dampen these forces, then there is too much elasticity in the system. This will result in such undesirable effects as unstable straight running, low steering response and propulsion unit oscillations.

It is, therefore, a principal object of this invention to provide an improved vibration damping arrangement for a marine outboard drive.

It is a further object of this invention to provide a damping arrangement for a marine outboard drive which permits not only the damping of propulsion unit thrust, but also couples which may be exerted on the outboard drive without adding excessive elasticity into the system.

SUMMARY OF THE INVENTION

This invention is adapted to be embodied in a thrust absorbing arrangement for a marine outboard drive mounted for pivotal movement about a horizontally extending tilt axis relative to a clamping member that is adapted to be affixed to the transom of an associated watercraft. A propulsion unit is provided at the lower end of the outboard drive for propelling the associated watercraft. In accordance with the invention, elastic abutment means are disposed between the lower end of the outboard drive and the clamping member for absorbing and damping rotational couples.

DETAILED DESCRIPTION OF THE PREFERRED EMBODIMENTS

Figure 1:
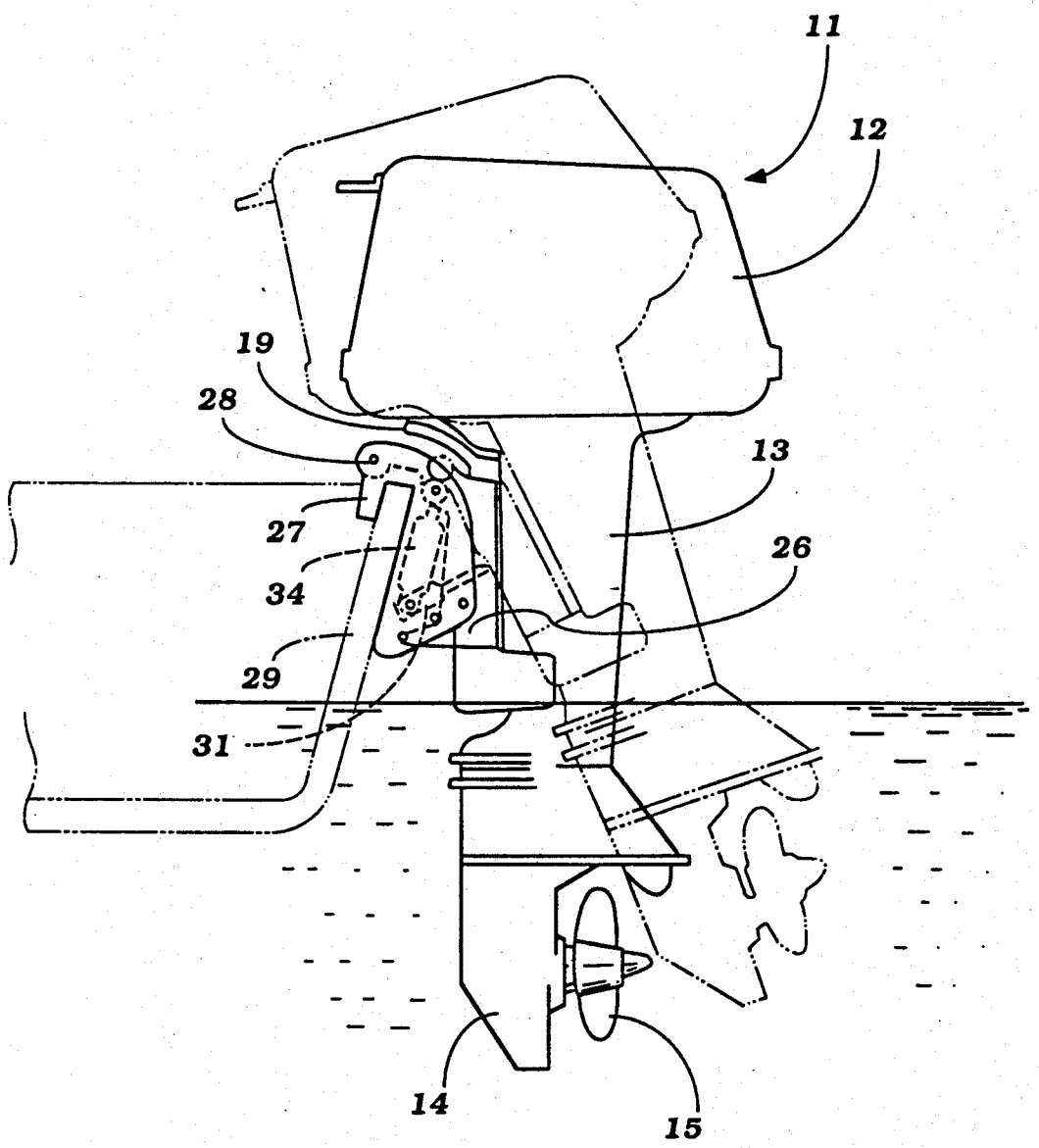
FIG. 1 is a side elevational view of an outboard motor constructed in accordance with an embodiment of the invention.

Referring first to FIG. 1, a marine outboard drive constructed in accordance with an embodiment of the invention is identified generally by the reference numeral 11. The outboard drive 11 is, in the illustrated embodiment, an outboard motor. It is to be understood, however, that certain facets of the invention can be employed with other types of marine outboard drives such as the outboard drive portion of an inboard/outboard drive.

The outboard motor 11 includes a power head 12 that contains an internal combustion engine (not shown) that is contained within a protective cowling. The internal combustion engine may be of any known type and reciprocating engines are normally used in such applications and have their output shafts rotatable about vertically extending axes. Such a construction may be assumed to be utilized in the preferred embodiment.

The output shaft of the engine of the power head 12 drives a drive shaft (not shown) that is rotatably journaled within a drive shaft housing 13 that is positioned at the lower end of the power head 12. A lower unit 14 depends from the drive shaft housing 13 and contains a suitable forward, neutral, reverse transmission for driving a propeller 15 in selected forward and reverse directions.

Figure 2:
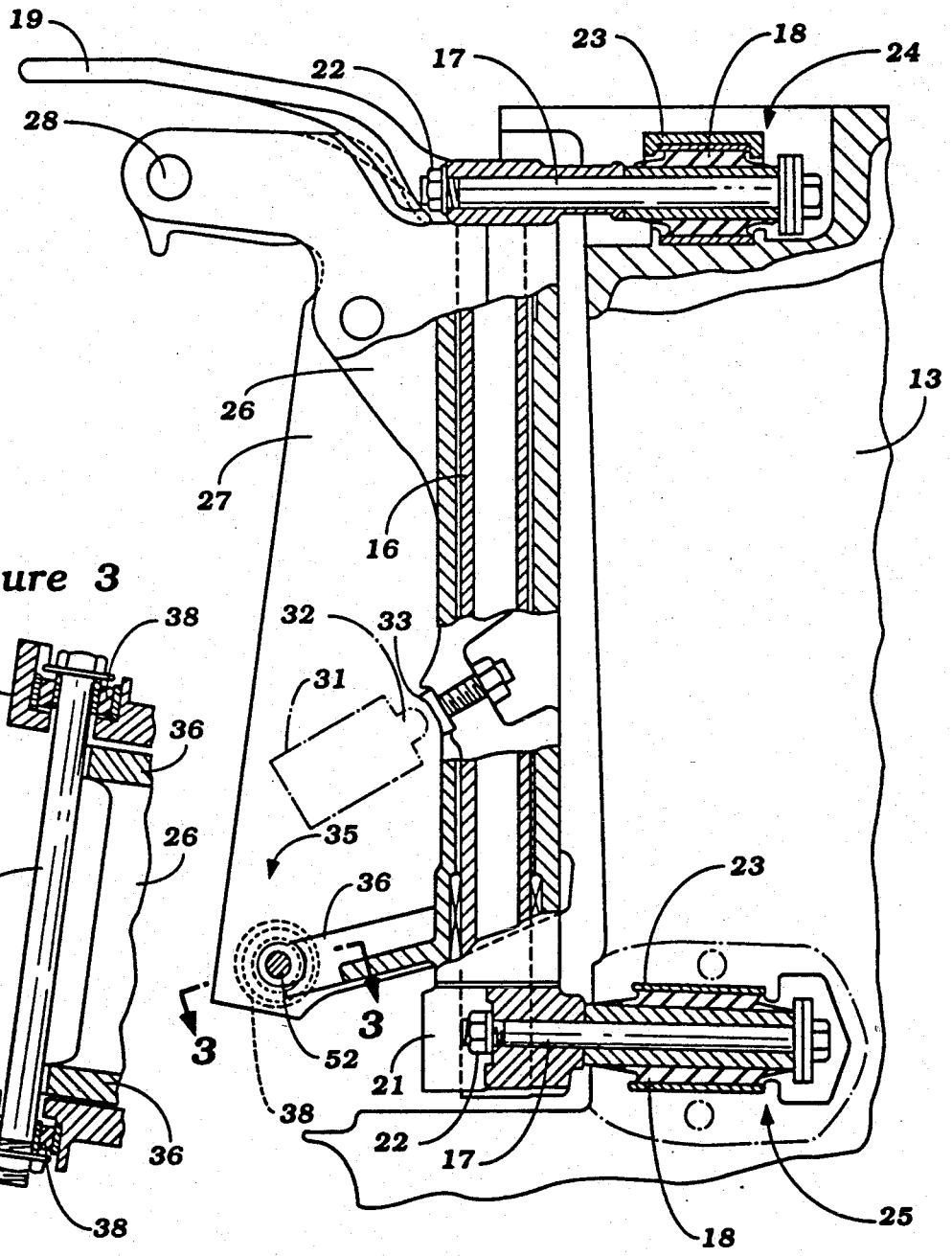
FIG. 2 is an enlarged side elevational view showing the relationship between the drive shaft housing, clamping member and swivel bracket, with portions broken away.

Referring now in detail additionally to FIG. 2, it will be noted that the drive shaft housing 13 is affixed to a steering shaft, indicated by the reference numeral 16 by means of an assembly that includes a pair of upper and lower fixing bolts 17 which pass through the sleeves of elastic bushings 18. The elastic bushings 18 are affixed against a steering arm 19 at their upper end and a clamping bracket 21 at their lower ends by means of nuts 22 that are affixed to the forward threaded ends of the bolts 17. The elastic sleeves 18 are bonded within outer sleeves 23 which are affixed in a suitable manner to the drive shaft housing 13. The upper and lower elastic connections between the drive shaft housing 13 and the steering shaft 16 are indicated by the reference numerals 24 and 25, respectively.

The steering shaft 16 is, in turn, journaled for steering movement within a swivel bracket 26. The swivel bracket 26 is, in turn, pivotally connected to a clamping bracket 27 by means of a tilt pin 28 so as to permit tilt and trim movement of the outboard motor 11 about a horizontally disposed axis defined by the tilt pin 28.

The clamping bracket 27 is designed to be affixed to a transom 29 of an associated watercraft which is shown partially and in phantom in FIG. 1.

In order to effect trim movement of the outboard motor 11, there may be provided a trim hydraulic motor 31 which has a piston rod 32 that cooperates with a socket 33 fixed to the swivel bracket 26 for effecting trim adjustment. In addition, a tilt fluid motor 34 is affixed between the clamping bracket 27 and the swivel bracket 26 for effecting tilt up movement of the outboard motor.

The construction as thus far described may be considered to be conventional and, for that reason, further details of the construction have not been illustrated nor will they be described. However, in conjunction with the prior art type of constructions, the elastic bushings 24 and 25 have some degree of resilience to dampen the driving thrust between the propeller 15 and the transom 29 of the associated watercraft. However, these elastic bushings cannot effectively absorb rotational couples occurring about the drive shaft axis and caused either by torsional vibrations or by vibrations due to rotational fluctuations caused by irregular combustion. If these bushings had sufficient resilience to dampen those forces, then there would be too much resilience in the system and lack of steering sensitivity, unstable straight running and propulsion unit oscillations would occur.

Figure 3:
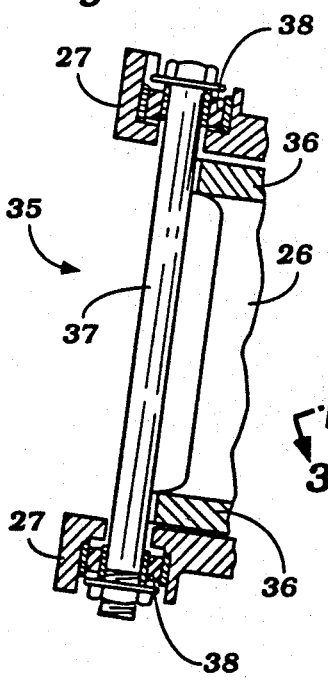
FIG. 3 is a cross sectional view taken along the line 3—3 of FIG. 2.

In accordance with the invention, an arrangement is provided for dampening these forces and which may have a lower spring rate while, at the same time, avoiding any loss of steering accuracy or the other disadvantages discussed above. In this embodiment, this damping arrangement is depicted generally by the reference numeral 35 and is shown in most detail in FIGS. 2 and 3. It will be noted that the lower end of the swivel bracket 26 is provided with a forwardly extending projection 36 which has a pair of spaced apart arms that have arcuate forward edges. These arms are juxtaposed to a rod 37 which spans the clamping bracket 27 and which is affixed thereto by elastic joints 38. The joints 38 have a relatively low spring rate. When the rotational couples aforedescribed are exerted, they will be dampened by these elastic sleeves 38. However, these sleeves 38 add no resilience to the steering connection and hence no loss in steering crispness will be encountered.

Figure 4:
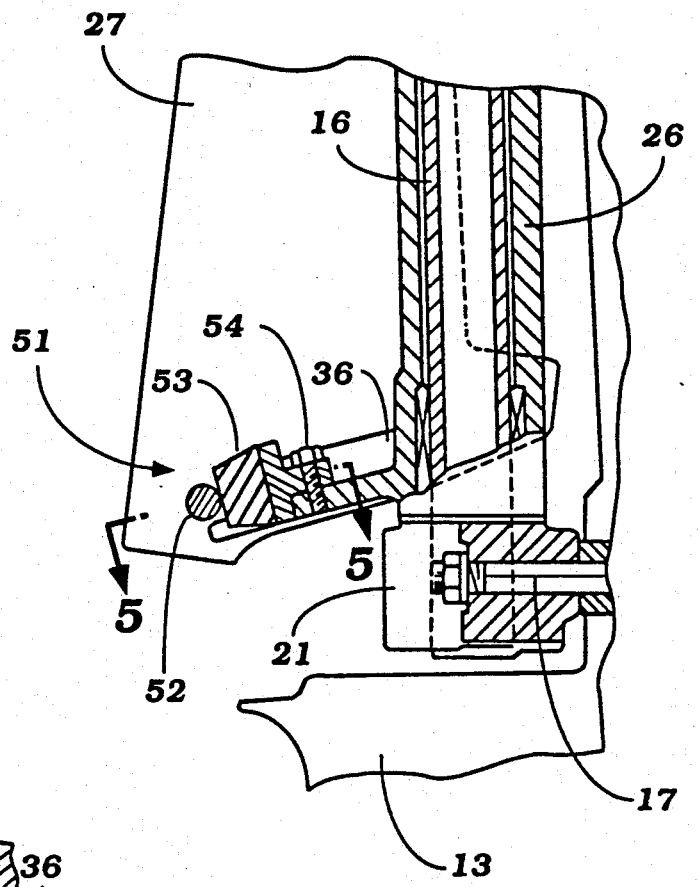
FIG. 4 is a partial side elevational view, with portions broken away, showing another embodiment of the invention.
Figure 5:
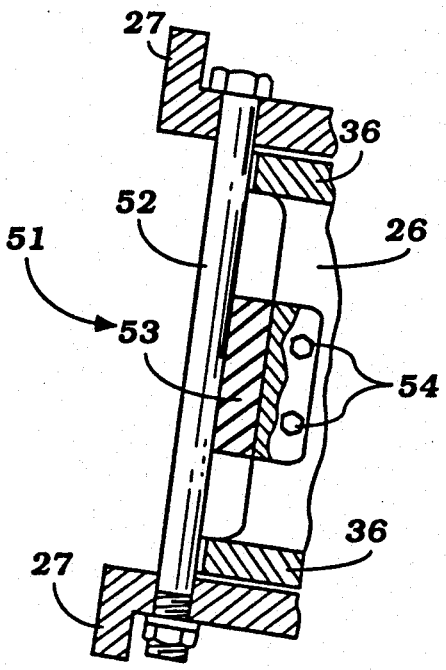
FIG. 5 is a cross sectional view taken along the line 5—5 of FIG. 4.

FIGS. 4 and 5 show another embodiment of the invention. In this embodiment, components which are the same as those of the previously described embodiment have been identified by the same reference numerals and will not be described again, except insofar as is necessary to understand the construction and operation of this embodiment. In this embodiment, the damping mechanism is indicated generally by the reference numeral 51. In this embodiment, a rod 52 spans the clamping bracket 27 and is rigidly affixed to it. However, the projection 36 of the swivel bracket 26 does not engage this rod. Rather, there is provided an elastic block 53 which is affixed thereto by threaded fasteners 54 and which is interposed between the rod 52 and the bracket extension 36. Hence, the elastic block 53 will provide the same damping action as the elastic sleeves 38 of the previously described embodiment. Hence, the same advantages will be achieved.

It should be readily apparent from the foregoing description that the described construction is very effective in providing good damping of both driving thrusts and of rotational couples caused by engine vibrations or fluctuations caused by irregular combustion without loss of steering crispness and straight ahead running ability. Of course, the described embodiments are those of preferred constructions which the invention may take. Various changes and modifications may be made without departing from the spirit and scope of the invention, as defined by the appended claims.

I claim:

1. A vibration absorbing arrangement for a marine outboard drive mounted for pivotal movement about a horizontally extending tilt axis relative to a clamping member adapted to be affixed to the transom of an associated watercraft, a propulsion unit at the lower end of said outboard drive for propelling the watercraft, and a first element affixed to said clamping member engaged by a second member affixed to said lower end of said outboard drive, at least one of said elements including elastic abutment means for absorbing and dampening rotational vibrations and for limiting the degree of pivotal movement of said outboard drive toward said transom without limiting the degree of pivotal movement in the opposite direction.

2. A vibration absorbing arrangement as set forth in claim 1 wherein the first element comprises a rod extending transversely across the front of the outboard drive and carried by the clamping member, the second element comprises an abutment member extending forwardly from the outboard drive and juxtaposed to the rod and the elastic abutment means comprises an elastic joint.

3. A vibration absorbing arrangement as set forth in claim 2 wherein the elastic joint is in the connection between the rod and the clamping member.

4. A vibration absorbing arrangement as set forth in claim 2 wherein the elastic joint is formed by the abutment member.

5. A vibration absorbing arrangement as set forth in claim 1 wherein the propulsion unit comprises a drive shaft housing affixed to a steering shaft which steering shaft is journaled in a swivel bracket and wherein the elastic abutment means is interposed between the swivel bracket and the clamping member.

6. A vibration absorbing arrangement as set forth in claim 5 wherein the steering shaft is affixed to the drive shaft housing by elastic bushings having their axes disposed in the direction of the driving thrust from the propulsion means.

7. A vibration absorbing arrangement as set forth in claim 6 wherein the elastic bushings have a substantially lower resilience than the elastic abutment means.

8. A vibration absorbing arrangement as set forth in claim 7 wherein the first element comprises a rod extending transversely across the front of the outboard drive and carried by the clamping member, the second element comprises an abutment member extending forwardly from the outboard drive and juxtaposed to the rod and the elastic abutment means comprises an elastic joint.

9. A vibration absorbing arrangement as set forth in claim 8 wherein the elastic joint is in the connection between the rod and the clamping member.

10. A vibration absorbing arrangement as set forth in claim 8 wherein the elastic joint is formed by the abutment member.

11. A vibration absorbing arrangement for a marine outboard drive mounted for pivotal movement about a horizontally extending tilt axis relative to a clamping member adapted to be affixed to the transom of an associated watercraft, a propulsion unit at the lower end of said outboard drive for propelling the watercraft, and elastic abutment means interposed between the lower end of said outboard drive and said clamping member for absorbing and dampening rotational vibrations, and elastic abutment means comprising a rod extending transversely across the front of said outboard drive and carried by said clamping member, an abutment member extending forwardly from said outboard drive and juxtaposed to said rod and an elastic joint.

12. A vibration absorbing arrangement as set forth in claim 11 wherein the elastic joint is in the connection between the rod and the clamping member.

13. A vibration absorbing arrangement as set forth in claim 11 wherein the elastic joint is in the connection between the rod and the abutment member.

14. A vibration absorbing arrangement as set forth in claim 11 wherein the propulsion unit comprises a drive shaft housing affixed to a steering shaft which steering shaft is journaled in a swivel bracket and wherein the elastic abutment means is interposed between the swivel bracket and the clamping member.

15. A vibration absorbing arrangement as set forth in claim 14 wherein the steering shaft is affixed to the drive shaft housing by elastic bushings having their axes disposed in the direction of the driving thrust from the propulsion unit.

16. A vibration absorbing arrangement as set forth in claim 15 wherein the elastic bushings have a substantially lower resilience than the elastic abutment means.

17. A vibration absorbing arrangement as set forth in claim 16 wherein the elastic abutment means comprises a rod extending transversely across the front of the outboard drive and carried by the clamping member, an abutment member extending forwardly from the outboard drive and juxtaposed to the rod and an elastic joint.

18. A vibration absorbing arrangement as set forth in claim 17 wherein the elastic joint is in the connection between the rod and the clamping member.

19. A vibration absorbing arrangement as set forth in claim 17 wherein the elastic joint is in the connection between the rod and the abutment member.

* * * * *

UNITED STATES PATENT AND TRADEMARK OFFICE

CERTIFICATE OF CORRECTION

PATENT NO. : 5,219,306

DATED : June 15, 1993

INVENTOR(S) : Hideharu Takahashi

It is certified that error appears in the above-indentified patent and that said Letters Patent is hereby corrected as shown below:

Title page: Item [30] "Foreign Application Priority Data", "1991" should be --1990--.

Signed and Sealed this

Twenty-second Day of March, 1994

Bruce Lehman

*Attest:*

BRUCE LEHMAN

*Attesting Officer*

*Commissioner of Patents and Trademarks*